US008664864B2

(12) United States Patent
Salsbury

(10) Patent No.: US 8,664,864 B2
(45) Date of Patent: Mar. 4, 2014

(54) METHOD AND APPARATUS FOR CONTROLLING AND MEASURING ASPECTS OF TIME-VARYING COMBINED LIGHT

(75) Inventor: Marc Salsbury, Ottawa (CA)

(73) Assignee: Koninklijke Philips N.V., Eindhoven (NL)

( * ) Notice: Subject to any disclaimer, the term of this patent is extended or adjusted under 35 U.S.C. 154(b) by 373 days.

(21) Appl. No.: 13/061,163

(22) PCT Filed: Aug. 24, 2009

(86) PCT No.: PCT/IB2009/053719

§ 371 (c)(1), (2), (4) Date: Feb. 28, 2011

(87) PCT Pub. No.: WO2010/026509

PCT Pub. Date: Mar. 11, 2010

(65) Prior Publication Data

US 2011/0156596 A1 Jun. 30, 2011

Related U.S. Application Data

(60) Provisional application No. 61/095,018, filed on Sep. 8, 2008.

(51) Int. Cl.
*H05B 37/02* (2006.01)

(52) U.S. Cl.
USPC ..... 315/152; 315/308

(58) Field of Classification Search
USPC ..... 315/308, 152
See application file for complete search history.

(56) References Cited

U.S. PATENT DOCUMENTS

| | | | | |
|---|---|---|---|---|
| 6,016,038 | A * | 1/2000 | Mueller et al. | 315/291 |
| 6,211,626 | B1 * | 4/2001 | Lys et al. | 315/291 |
| 6,856,382 | B2 * | 2/2005 | Cahill et al. | 356/5.04 |
| 7,315,139 | B1 * | 1/2008 | Selvan et al. | 315/291 |
| 2006/0006821 | A1 * | 1/2006 | Singer et al. | 315/312 |

FOREIGN PATENT DOCUMENTS

| | | | |
|---|---|---|---|
| WO | 2007090283 | A1 | 8/2007 |
| WO | 2007121574 | A1 | 11/2007 |

* cited by examiner

*Primary Examiner* — Jerome Jackson, Jr.
*Assistant Examiner* — David Lotter
(74) *Attorney, Agent, or Firm* — Mark L. Beloborodov

(57) ABSTRACT

Methods and apparatus are disclosed for providing combined time-varying light comprising light from one or more light sources (132, 134, 136), and determining aspects of light from one or more light sources based on measurements of the combined light. Light sources of one or more colors can be controlled to provide time-varying combined light outputs (310, 360) using different switching sequences for different light sources, for example according to PWM, PCM, or other modulation methods. By appropriately configuring the timing of the switching sequences, the combined light output can be made to exhibit a plurality of lighting combinations. A broadband optical sensor (148) can be configured to measure (145) some or all of the plurality of lighting combinations, and the measurements used to determine light output measurements of portions of the combined light, and optionally of ambient light, by appropriate processing (150) of the measurements.

20 Claims, 5 Drawing Sheets

METHOD AND APPARATUS FOR CONTROLLING AND MEASURING ASPECTS OF TIME-VARYING COMBINED LIGHT

TECHNICAL FIELD

The present invention is directed generally to a method and apparatus for controlling and measuring properties of time-varying combined light. More particularly, various inventive methods and apparatus disclosed herein relate to generating and measuring variable light comprising various combinations of light from component light sources, and determining aspects of light from one or more of the component light sources based on measurements of the combined light.

BACKGROUND

Digital lighting technologies, i.e. illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g. red, green, and blue, as well as a processor for independently controlling the output of the LEDs in order to generate a variety of colors and color-changing lighting effects, for example, as discussed in detail in U.S. Pat. Nos. 6,016,038 and 6,211,626.

In various lighting applications, light from one or more LEDs or other light sources are mixed to provide a combined lighting effect, such as a desired chromaticity of combined light. To this end, light from each of the light sources can be controlled with regard to factors such as intensity of light. For example, instantaneous or time-average intensity of light from light sources such as LEDs can be controlled using methods such as direct drive current control and drive current pulse width modulation (PWM) control.

Controlling aspects of light from a light source such as an LED by controlling the drive signals supplied thereto can present some challenges. For example, due to factors such as device aging, device heating and ambient lighting conditions, relationships between drive signals supplied to a light source and characteristics of the light emitted in response to said drive signals can change over time. To compensate for such changes, several optical feedback solutions have been considered which measure light source input-output characteristics in mixed-light applications in order to accurately control the light emitted by each light source and thus to control the mixed light.

One solution focusing on measuring light from component light sources contemplates a plurality of light filters or filtered sensors in order to discriminate light from each light source on the basis of the spectra of light emitted thereby. Light output from each LED can be measured and compared to a desired output, and lighting corrections can be made accordingly. A drawback of this solution is that it can be costly and difficult to provide multiple color filters tuned to the light output of each LED, while rejecting the light output of other LEDs.

Another solution employs a single sensor and measures light output of different LEDs by employing an electronic control circuit which turns off the LEDs not being measured in a sequence of time pulses. This allows direct measurement of each LED independently. The measured light output for each LED is compared to a desired output, which may be determined by user inputs, and corrections to the current for each color are made accordingly. A drawback of this solution is that time intervals must be set aside for the measurement operation, which can interrupt continuity of lighting applications.

A similar solution employs a single sensor and measures light output of different LEDs by employing an electronic control circuit which turns off the LED being measured in a sequence of time pulses. The light output of the LED being measured is then computed by subtracting the light output corresponding to all LEDs but the LED being measured being on from the light output corresponding to all LEDs being on. Measured light outputs for the colors are compared to desired outputs, which may be set by user controls, and changes to the power supply for the color blocks are made as necessary. A drawback of this solution is that time intervals must be set aside for the measurement operation, which again can interrupt continuity of lighting applications.

A solution which avoids the need for specific calibration periods is implementable when PWM drive current control is used to control light from multiple LEDs, more specifically when the PWM drive pulses for each LED are partially overlapping. According to this solution, the peak light output and the drive current of a first LED are simultaneously measured at a point in time when the PWM drive pulses do not overlap, and the combined peak light output and the drive current of a second LED are simultaneously measured at another point in time when the PWM drive pulses overlap. The peak light output of the second LED is determined by subtracting the two measurements and the ratio of peak light output to peak current can be used for feedback control purposes. A drawback of this solution is that it requires monitoring of the drive currents, and there is no method provided by which the required partial overlapping of PWM drive pulses can be achieved, nor is there a method provided for initiating measurements of the light at the appropriate points in time.

Thus, there is a need in the art to provide method and apparatus by which aspects of mixed light can be controlled and measured which does not suffer from at least one of the drawbacks identified above.

SUMMARY

The present disclosure is directed to inventive methods and apparatus for light intensity control and feedback. For example, light sources of one or more colours can be controlled to provide time-varying combined light outputs using different switching sequences for different light sources, for example according to PWM, PCM, or other modulation methods. By appropriately configuring the timing of the switching sequences, the mixed light output can be made to exhibit a plurality of lighting combinations. A broadband light sensor can be configured to measure some or all of the plurality of lighting combinations, and the measurements used to determine light output measurements of portions of the combined light, and optionally of ambient light, by appropriate processing of the measurements.

Generally, in one aspect, there is provided an apparatus for controlling and measuring light. The apparatus comprises a controller module operatively coupled to two or more light sources. The controller module is configured to generate two or more switching sequences. Each switching sequence is used for controlling operation of at least one light source. The two or more switching sequences are configured to result in generation of a desired lighting effect and two or more different measurable combinations of light. At least one measurable combination of light comprises light from one or more of the light sources. The apparatus also comprises a light measurement module operatively coupled to the controller module. The light measurement module is configured to receive signals indicative of the switching sequences. The light measurement module is further configured to define one or more measurement sequences based on the switching sequences. The light measurement module is further configured to provide one or more light measurements based on the measurement sequences. The apparatus also comprises a processing module operatively coupled to the light measurement module and the controller module. The processing module is configured to determine an indication of light output by at least one of the two or more light sources, based at least in part on the one or more light measurements and the two of more switching sequences.

In another aspect of the present invention, there is provided a method for controlling and measuring light comprising light generated by two or more light sources. The method comprises the step of providing two or more switching sequences. Each switching sequence is used for controlling operation of at least one light source. The two or more switching sequences are configured to result in generation of a desired lighting effect and two or more different measurable combinations of light. At least one measurable combination of light comprises light from one or more of the light sources. The method further comprises the step of providing one or more measurement sequences based on the switching sequences. The method further comprises the step of providing one or more light measurements based on the measurement sequences. The method further comprises the step of processing the one or more light measurements to determine an indication of light output by at least one of the two or more light sources, based at least in part on the one or more light measurements and the two or more switching sequences.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of from approximately 700 degrees K (typically considered the first visible to the human eye) to over 10,000 degrees K; white light generally is perceived at color temperatures above 1500-2000 degrees K.

Lower color temperatures generally indicate white light having a more significant red component or a "warmer feel," while higher color temperatures generally indicate white light having a more significant blue component or a "cooler feel." By way of example, fire has a color temperature of approximately 1,800 degrees K, a conventional incandescent bulb has a color temperature of approximately 2848 degrees K, early morning daylight has a color temperature of approximately 3,000 degrees K, and overcast midday skies have a color temperature of approximately 10,000 degrees K. A color image viewed under white light having a color temperature of approximately 3,000 degree K has a relatively reddish tone, whereas the same color image viewed under white light having a color temperature of approximately 10,000 degrees K has a relatively bluish tone.

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

The term "addressable" is used herein to refer to a device (e.g., a light source in general, a lighting unit or fixture, a controller or processor associated with one or more light sources or lighting units, other non-lighting related devices, etc.) that is configured to receive information (e.g., data) intended for multiple devices, including itself, and to selectively respond to particular information intended for it. The term "addressable" often is used in connection with a networked environment (or a "network," discussed further below), in which multiple devices are coupled together via some communications medium or media.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

The term "light sensor" as used herein refers to an apparatus configured to provide a signal indicative of one or more aspects of light when exposed thereto. For example, a photodiode can be configured to provide an electrical signal indicative of intensity of light incident thereupon. Light sensors can further comprise light filters or other optical elements which can be used to affect the response characteristics of the light sensor, for example by increasing or decreasing responsivity to incident light at one or more wavelengths.

The term "ambient light" is used herein to refer to light from sources external to the lighting unit or lighting fixture under discussion. Ambient light can include natural or artificial light, or light from another lighting unit or lighting fixture. Ambient light can change over time or remain substantially the same for periods of time.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
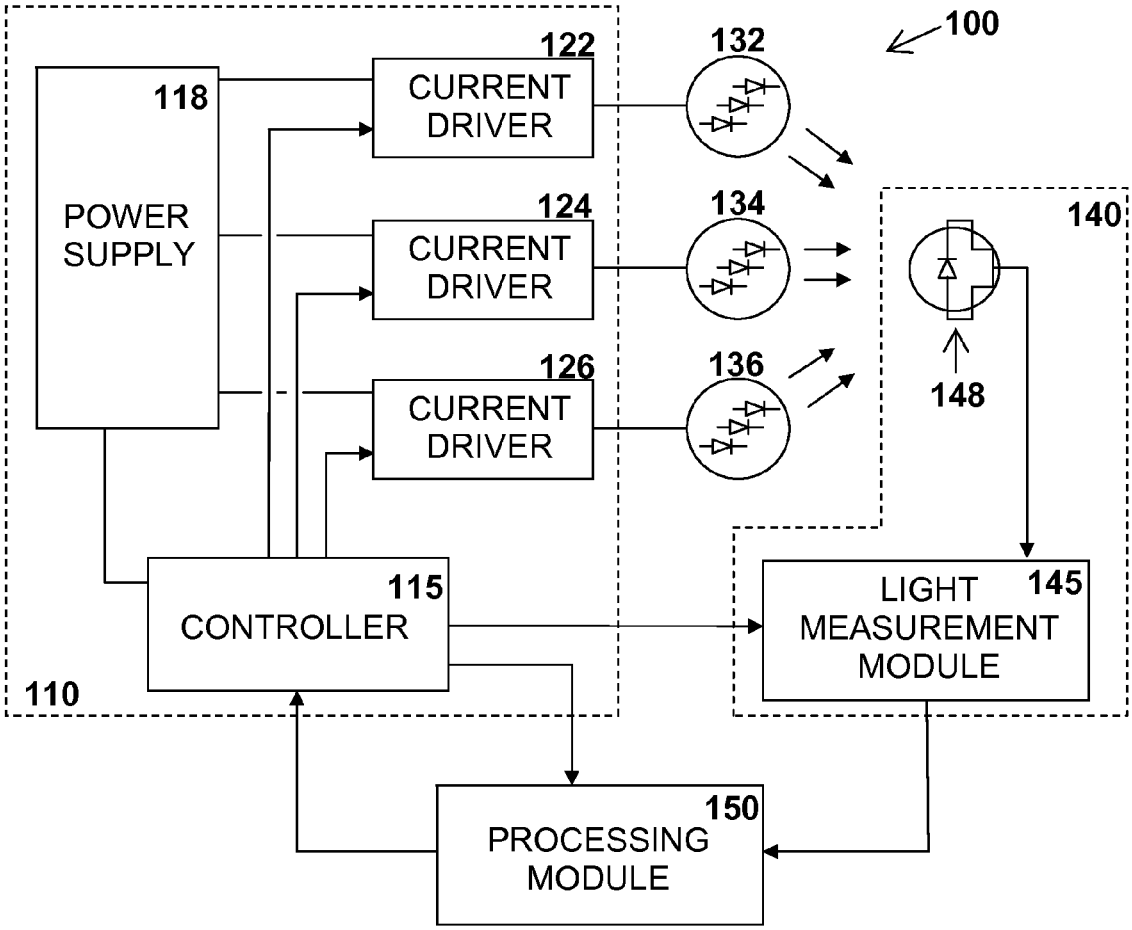
FIG. 1 illustrates an apparatus for controlling and measuring light in accordance with an embodiment of the present invention.

The present invention arises from the realization that aspects of mixed light emitted by a combination of light sources, such as luminous flux and chromaticity, can be maintained at a desired level by adjusting the drive current of the light sources in accordance with optical feedback. This allows the controller to compensate for variable lighting characteristics due, for example, to light source temperature, device aging, ambient lighting conditions, and the like. However, in a mixed lighting system, feedback control can be limited by the degree to which light from different sources can be discriminated and measured. In addition, optical feedback control solutions can be limited by their complexity, as well as by requirements to balance optical feedback requirements with other lighting requirements.

The present invention seeks to overcome certain limitations of present optical feedback control systems. In particular, it is desired to drive two or more light sources so as to generate a desired lighting effect while also generating a plurality of different measurable combinations of light which can be sensed by a broadband optical sensor for optical feedback. It is further desired to operatively couple light source drive control with light measurement control to provide an integrated optical feedback solution.

More generally, Applicants have recognized and appreciated that it would be beneficial to control different light sources, using different control signals, so as to provide both a desired lighting effect and a plurality of measurable combinations of light, and to measure and process the measurable combinations of light based on the control signals. This processing can be configured to determine an indication of light output by at least one light source for optical feedback purposes.

In view of the foregoing, various embodiments and implementations of the present invention are directed to providing methods and apparatus for controlling and measuring light, wherein two or more light sources are controlled using two or more switching sequences, for example indicative of pulse width modulation (PWM) or pulse code modulation (PCM) waveforms, or other pulsed or switched waveforms. The two or more switching sequences are configured to result in generation of a desired lighting effect, such as mixed light having a desired color and intensity. In addition, the two or more switching sequences are configured to result in generation of two or more different measurable combinations of light, at least one measurable combination of light comprising light from one or more of the light sources. For example, a measurable combination of light can comprise light from any one light source, two or more light sources, one or more light sources plus ambient light, or ambient light only. The present invention also provides for defining one or more measurement sequences based on the switching sequences. The measurement sequences thus defined are used to provide a sequence of light measurements, each light measurement indicative, for example, of intensity of light from the light source and optionally of ambient light. By defining the measurement sequences based on the switching sequences, a plurality of lighting combinations can be measured. If sufficient lighting combinations are measured, they can then be processed to determine an indication of light output by at least one of the two or more light sources. The processing can be based at least in part on the switching sequences, for example to provide an indication of which light sources are being measured.

Referring to FIG. 1, in one embodiment, there is provided an apparatus for controlling and measuring light. The apparatus comprises a controller module 110 configured to generate switching sequences for controlling operation of each of light sources 132, 134 and 136. The controller module includes a controller 115 for generating the switching sequences, based on a desired lighting effect provided by a user or other device through an interface (not shown), and based on feedback from the processing module 150. The switching sequences are supplied to current drivers 122, 124 and 126, which can produce switched drive currents for driving the light sources 132, 134 and 136, respectively. A power supply 118 provides power for this purpose. Light from the light sources 132, 134 and 136 is mixed for example by an optical system (not shown), optionally with other light such as ambient light, and an optical sensor 148 is configured to measure aspects of a portion of the mixed light. For example, the optical sensor 148 can be a single broadband optical sensor configured to measure total intensity of the mixed light. The optical sensor 148 provides a signal indicative of measured aspects of the mixed light to a light measurement module 145. A signal from the optical sensor, for example an analog or digital electrical signal, is referred to herein as the optical signal.

Continuing with reference to FIG. 1, the light measurement module 145 is operatively coupled to the controller module 110 and receives therefrom signals indicative of the switching sequences, which can be used to configure one or more measurement sequences. The measurement sequences can be used to determine time intervals at which the optical signal is sampled to obtain one or more light measurements. The light measurement module 145 subsequently provides signals indicative of the one or more light measurements to a processing module 150. The light measurement module 145 or the processing module 150 can be configured to provide an indication of the status of the light sources 132, 134 and 136 during times relevant to each light measurement. For example, a light measurement can be tagged as corresponding to light comprising light from one specified light source, two or more specified light sources, one or more specified light sources with ambient light, or ambient light only. Alternatively, light measurements can be stored in predetermined memory locations indicative of a relevant correspondence. The processing module 150 is configured to process the light measurements, along with the associated indications of light source status, for example using operations such as multiplication, addition and subtraction, to determine one or more indications of light output by a subset of the light sources 132, 134 and 136. The indications of light output can be provided back to the control module 110 for feedback control purposes. In addition, the light measurement module 145 or the processing module 150 can optionally be configured to provide the control module 110 with indications to modify the switching sequences in the event that the current switching sequences are insufficient for providing satisfactory indications of light output.

Figure 2:
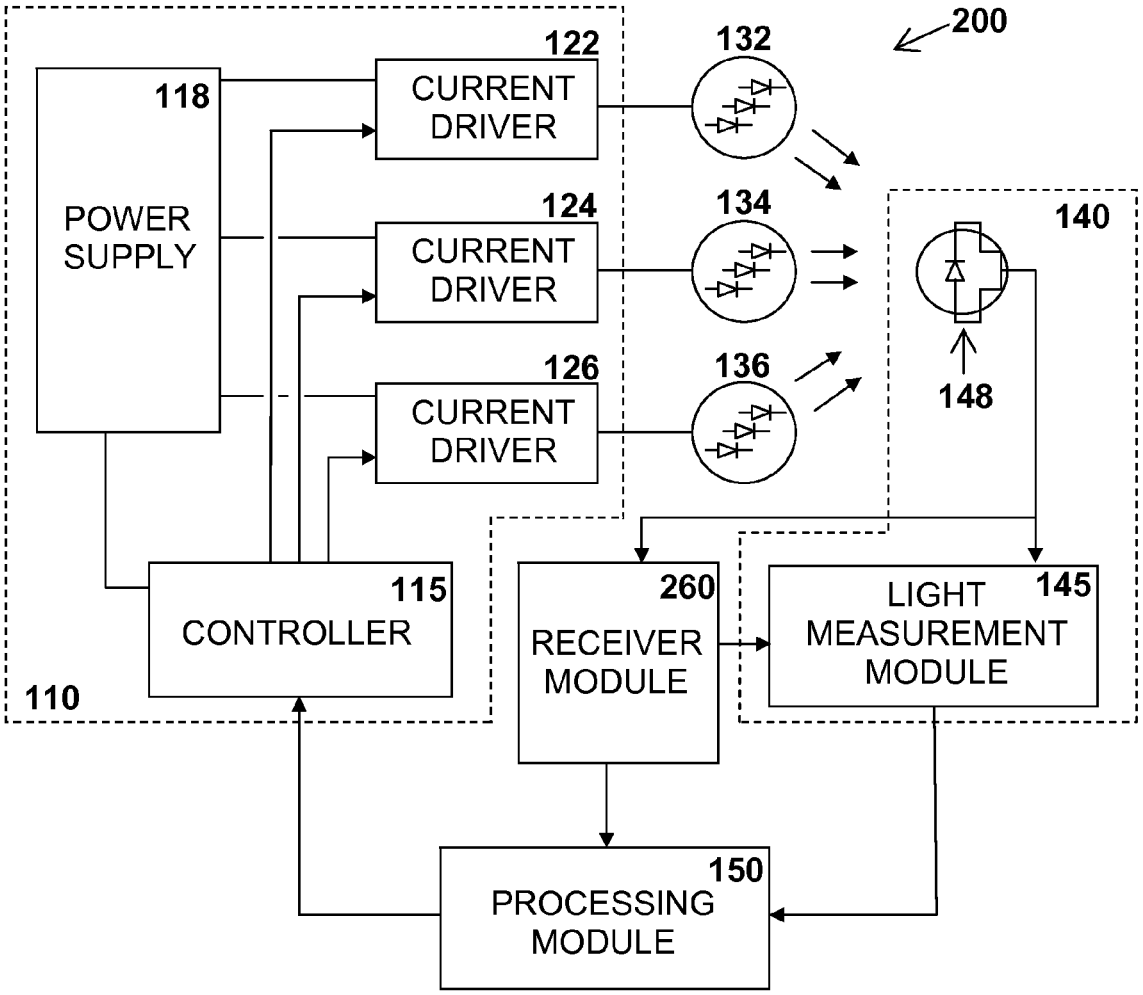
FIG. 2 illustrates an apparatus for controlling and measuring light in accordance with another embodiment of the present invention.

FIG. 2 illustrates an apparatus 200 for controlling and measuring light in accordance with one embodiment of the present invention. The apparatus 200 operates similarly to the apparatus 100 illustrated in FIG. 1, except that information regarding the switching sequences is transmitted optically through the light sources 132, 134 and 136, received by the optical sensor 148, and routed to a receiver module 260. The receiver module then analyzes, decodes or demodulates the information to provide signals indicative of the switching sequences to the light measurement module and/or the processing module. By using the existing optical medium to transmit information regarding the switching sequences, connections to the controller module can be simplified.

Light Sources

The present invention provides for two or more controllable light sources, for example arrays of LEDs or other light sources controllable by an electric drive current. Aspects of the light from each light source, such as the radiant or luminous flux or other indicator of intensity of light, can be controlled for example by controlling the amount of drive current supplied thereto, or by other means as would be understood by a worker skilled in the art.

In one embodiment, pulse modulated drive currents, according to methods such as pulse-width modulation (PWM), pulse code modulation (PCM), pulse position modulation (PPM), pulse amplitude modulation (PAM) or the like, can be used to control the light sources. As is known in the art, driving light sources such as LEDs using a pulsed drive current typically results in pulsed light at frequencies related to the pulse frequency. For sufficiently high pulse frequencies, such pulsed light can be perceived without noticeable flicker, since the human eye tends to perceive an "average" of the pulsed light. In addition, the perceived intensity of pulsed light at such frequencies can be proportional to the pulse duty cycle, pulse density, time-average light intensity, or the like. Therefore, it is possible to control the amount of light generated by different light sources by adjusting the duty factor or pulse density of the pulsed drive current supplied thereto. For example, dimming or adjusting of red light sources, green light sources, or blue light sources in a multi-channel lighting unit affects the mixed radiant flux output thereof.

Each light source can output light of a different color or spectrum. For example, a multi-channel lighting unit can be provided comprising different arrays which can generate radiation in the red, green, and blue regions of the visible spectrum. It is noted that in other embodiments different arrays may comprise nominally equal color light sources. Alternative embodiments of the present invention can employ light sources with other than three different colors, for example including light sources of colors such as amber, pink, cyan or white. The light sources can be thermally connected to a common heat sink or alternatively to separate heat sinks (not shown) or other thermal management systems such as heat pipes, thermosyphons, or the like for improved thermal management of certain operating conditions of the light sources.

In some embodiments, a lighting unit according to the present invention includes mixing optics for intermixing the light emitted by the different color light sources. It is noted that when differently colored light sources emit light which is adequately mixed, controlling color and intensity of the mixed light is then a matter of controlling the amount of light provided by each of the same color light sources. The color of the mixed light can thus be controlled within a range of colors defined by the color gamut of the lighting unit. The color gamut is defined by the different color light sources within the multi-channel lighting unit subject to achievable operating conditions.

Controller Module

Embodiments of the present invention further provide for a controller module for controlling light emitted by the light sources. The controller module can comprise a controller such as a microcontroller configured for feedback control of the light sources or the mixed light thereof. For example, linear feedback control methods such as PID control, closed-loop control, adaptive control, nonlinear feedback control methods, or a combination of feedforward and feedback control methods can be implemented by the controller. Feedback control involves configuring signals controlling intensity of two or more light sources, for example in the form of switching sequences, in response to feedback indicative of light output of at least one of the two or more light sources.

In various embodiments of the present invention, the controller can be coupled to a user interface or a device interface which supplies a desired lighting effect to be implemented by the controller. The desired lighting effect may be substantially constant or time-varying, and can specify aspects such as color, chromaticity, luminance, and/or intensity of light. The controller can be configured to track, for example with a desired smoothness, the desired lighting effect through variations thereof or through other variations such as due to ambient light, device aging, device temperature changes, and the like.

In one embodiment, the controller can access a saved lighting sequence, for example stored in memory, which supplies a time-varying sequence of desired lighting effects. For example, the saved lighting sequence can be preset during manufacture.

In many embodiments, the controller is operatively coupled to one or more current drivers, which are in turn coupled to each light source or array of light sources and are configured to separately supply current thereto. The controller supplies a switching sequence to each current driver which is used to configure a time-varying current supplied by the current driver. A power supply can be coupled to the current drivers for providing electrical power. The current drivers control the amount of drive current supplied to and hence the amount of light emitted by each light source. The current drivers can be configured to regulate the supply of current to each light source separately so as to control properties of the combined mixed light, such as luminous flux and chromaticity. The current drivers can be current regulators, switches or other similar devices as would be known in the art. Alternate control techniques for controlling the activation of the light sources would be readily understood by a worker skilled in the art.

In one embodiment, an adequate heat dissipation or thermal management system can be coupled to the current drivers and optionally to the light sources to dissipate excess heat generated thereby. For example, one or more heat sinks, heat pipes, thermosyphons, forced liquid or air cooling systems, convective cooling systems, or the like can be employed for this purpose. Thermal information can further be collected and supplied to the controller for feedback control purposes.

Those having skill in the art will recognize that the PWM or PCM or so forth control signals generated by the controller can be implemented using computer software or firmware provided by a computer readable medium having instructions for determining the pulse generation control signal sequence. For example, computer readable media such as optical or magnetic storage media, RAM, ROM or the like can carry instructions readable by a generic or special-purpose computing device configured to carry out drive control, for example a processor, controller, or the like. It will be readily apparent that similarly configured computer software can be used to enable other aspects of the invention, such as processing optical signals and performing other methods and algorithms in accordance with various aspects of the present invention.

In some embodiment, current sensors are coupled to the output of the current drivers and continuously or intermittently sense the drive current supplied to the light sources. The current sensors can comprise a fixed resistor, a variable resistor, an inductor, a Hall Effect current sensor, or other element which has a known voltage-current relationship and can provide an adequately accurate indication of the drive current. The instantaneous forward currents supplied to the light sources can be measured by the current sensors which can communicate the sensed signals to a signal processing system coupled to the controller. The signal processing system can pre-process the drive current signals from the sensors and provide respective information to the controller. The signal processing system can include analog-to-digital (A/D) converters, amplifiers, filters, microprocessors, signal processors or other signal processing devices as would be readily understood by a person skilled in the art.

In another embodiment of the present invention, the output signals from the current sensors are directly forwarded to the controller for processing. In a further alternative embodiment, the peak forward currents for each light source can be fixed to a pre-set value to avoid having to measure the instantaneous forward currents. This may be useful, for example, for obtaining information about the current operative behaviour of light sources, such as light output as a function of input current. Such information can be useful for feedback control.

Switching Sequences

According to the present invention, the controller module is configured to provide signals to drive the light sources coupled thereto using switching sequences, for example determining separate pulsed drive currents supplied to each light source. The switching sequences are configured in accordance with two purposes. First, the switching sequences are configured to provide a desired lighting effect, for example by defining PWM, PCM or other pulsed waveforms for driving each light source to produce light of a desired intensity to obtain a desired mixed light. Second, the switching sequences are configured to provide a plurality of measurable combinations of light for feedback purposes.

For example, in one embodiment, red, green and blue light sources can each be driven in accordance with separate switching sequences defining pulsed drive currents. Aspects of the switching sequences, for example duty cycle or average value, can be configured to produce a mixed light having a desired lighting effect in the presence of ambient light, such as producing light of a desired color and/or intensity at a desired time. Other aspects of the switching sequences, for example the switching times thereof, can be configured to produce a plurality of measurable combinations of light. For example, during one time interval, all the light sources can be switched off, thus exhibiting ambient light only. During another time interval, only the red light source can be switched on. During another time interval, the red and blue light sources can be switched on. During another time interval, red, blue and green light sources can be switched on. Other measurable combinations of light are also possible. For example, for n controllable light sources, each with a configurations, such as intensity levels, up to $a^n$ measurable combinations of light may be possible. As a further example, in pulsed on/off light sources, a may be equal to two.

In one embodiment, the switching sequences can be configured to provide a desired plurality of lighting combinations while also providing a desired lighting effect. For example, parameters such as duty cycle, pulse density factor, or average value can be determined for each of the pulsed drive currents supplying the light sources in accordance with the desired lighting effect. Once these parameters are determined, a class of potential switching sequences for each light source can be defined which conform to these parameters. A set of switching sequences can then be selected from this class for operation of the light sources, wherein the selected switching sequence can be selected to provide adequate measurable combinations of light for measurement and feedback purposes.

For example, initial switching sequences can be provided for each light source which are configured in accordance with the desired lighting effect, for example resulting in pulsed drive currents having the appropriate duty cycle, duty factor, pulse density factor, or the like. The initial switching sequences can be evaluated to determine whether they will result in adequate measurable combinations of light. The initial switching sequences can be modified by time-shifting at least one of the switching sequences, or by adjusting the switching sequences so as to break up at least one of the pulsed drive currents resulting therefrom into a plurality of pulses, or alternatively to merge separate pulses. These modifications can be configured so that the desired lighting effect remains substantially unchanged while achieving measurable combinations of light. The modification of the switching sequences can be performed to provide other measurement opportunities not provided by the initial switching sequences, thereby enabling the provision of adequate measurable combinations of light.

In another embodiment, switching sequences can be configured to provide a trade-off between providing the desired lighting effect and providing adequate measurable combinations of light. For example, switching sequences can be associated with a measurement x indicative of the "distance" or error between the provided lighting effect to the desired lighting effect, and a measurement y indicative of the "distance" or error between the provided measurable combinations of light and a set of deemed adequate measurable combinations of light. A switching sequence can then be selected, for example, which results in a vector norm of (x,y), for example $ax^2+by^2$ for predetermined values of a and b, which provides a minimum value or a value below a predetermined threshold.

Adequately measuring a lighting combination requires at least a predetermined minimum period of time. For example, an optical sensor of a particular quality in an environment having a particular amount of optical noise can require a predictable minimum amount of time to adequately sample light to a predetermined degree of accuracy and precision. Therefore, it is desirable that measurable combinations of light exist for a minimum contiguous and/or cumulative amount of time in order to be adequately measured. An evaluation of the amount of time that one or more proposed measurable combinations of light are exhibited can, in some embodiments, be used for determining an indication of adequateness for the measurable combinations of light.

In one embodiment of the present invention, the switching sequences are further configured such that at least a portion of the measurable combinations of light defined thereby are exhibited for a predetermined amount of time.

In one embodiment, the switching sequences can be determined at least in part by feedback from the light measurement module and/or the processing module. For example, the light measurement module and/or processing module can be configured to provide feedback indicative of the actual lighting effect being provided, adequacy or inadequacy of the length of provided measurable combinations of light, or adequacy or inadequacy of the selection of provided measurable combinations of light. The controller module can be configured to adjust one or more of the switching sequences based on such feedback, for example to more accurately render the desired lighting effect or to provide more adequate measurable combinations of light for measurement and processing.

Optical Sensor

In accordance with various embodiments of the present invention, one or more optical sensors can be provided for detecting light including light output by the light sources. In one embodiment of the present invention, the optical sensor is a silicon photodiode with an optical filter that has a substantially constant responsiveness to spectral radiant flux for light within the practically relevant spectral range of light emitted by the light sources of the lighting unit. Optionally, multilayer interference filters which may require substantially collimated light may be used.

Light Measurement Module

The light measurement module provided in accordance with embodiments of the present invention is configured to provide one or more measurements of light, the light comprising light from the one or more light sources and optionally of ambient light. The light measurement module includes or is operatively coupled to one or more optical sensors for this purpose, and is further configured to receive signals indicative of the switching sequences determined by the controller module. The light measurement module is configured to define one or more measurement sequences based on the switching sequences. The measurement sequences are used to define times for light measurements, and optionally to provide an identifying means such as a tag, memory location, memory pointer, or other means for identifying correspondences between each light measurement and the lighting conditions under which the measurement was taken.

In embodiments of the present invention, the light measurement module can comprise electronics such as a controller, processor, memory, filters, timing devices, and communication devices, configured for performing operations of the light measurement module. One or more components of the light measurement module can be shared with the controller module and/or processing module, or alternatively the light measurement module can be substantially self-contained.

In embodiments of the present invention, the light measurement module can be configured to receive signals indicative of the switching sequences. For example, the light measurement module can be linked to the controller module using a wired, wireless or networked communication link. Alternatively, the optical signals received from the optical sensor can be processed to derive signals indicative of the switching sequences, and these signals provided to the light measurement module. In further embodiments, light from the light sources can be modulated to carry encoded information indicative of the switching sequences, or the optical signals can be analyzed directly to detect or determine the switching sequences, for example by monitoring for changes in illumination, such as jump changes. A receiver module can be configured to facilitate this monitoring.

Measurement Sequences

According to many embodiments of the present invention, the measurement sequences are configured to enable providing selected light measurements indicative of measurable combinations of light. For example, the measurement sequences can be configured to trigger different light measurements indicative of ambient light only, ambient light plus light from one selected light source, ambient light plus light from two selected light sources, and the like. By processing the switching sequences, adequate measurement sequences can be provided which allow each selected light measurement to be taken at appropriate time intervals. For example, a light measurement indicative of ambient light plus one or more selected light sources can be provided by configuring the measurement sequences to record average output of the optical sensor during one or more time intervals when the selected light sources are turned on.

In one embodiment, the measurement sequences can be further configured to account for factors such as response characteristics of the current drivers or light sources. For example, the measurement sequences can be configured to provide for sampling output of the optical sensor only once light output from the light sources has substantially stabilized after an on or off switching event.

In embodiments of the present invention, the measurement sequences can be configured to provide measurements of either all or only a portion of the available measurable combinations of light resulting from the switching sequences. For example, if more measurable combinations of light are available than are required for determining desired indications of light, then the measurement sequences may only result in a portion of the measurable combinations of light being measured. In further embodiments, the light measurement module or processing module can be configured to determine a portion of lighting combinations to be measured based on factors such as measurement quality and adequacy of the measured lighting combinations.

In embodiments of the present invention, the measurement sequences can be configured to provide more measurements than may be required for processing, for example by oversampling at least some of the measurable combinations of light. As is known in the art, oversampled, redundant, or otherwise additional measurements can be used for error detection, error correction, filtering and estimation such as least squares estimation, and the like. For example, by providing and processing additional measurements, embodiments of the present invention can be made more robust to noise, thereby enabling shortened time requirements for measuring each of the measurable lighting combinations.

Processing Module

The light processing module provided in accordance with embodiments of the present invention is configured to receive and process the one or more measurements of light provided by the light measurement module to determine an indication of light output by at least one of the light sources. Processing of the light measurements can be performed based in part on the switching sequences, which may be received from the control module or from another device such as the light measurement module or a receiver module, for example configured to determine or detect the switching sequences from signals provided by the optical sensor.

In embodiments of the present invention, the processing module can comprise electronics such as a controller, processor, memory, filters, timing devices, and communication devices, configured for performing operations of the processing module. One or more components of the processing module can be shared with the controller module and/or light measurement module, or alternatively the processing module can be substantially self-contained.

In embodiments of the present invention, the processing module is configured to receive signals indicative of the switching sequences. For example, the processing module can be linked to the controller module using a wired, wireless or networked communication link. Alternatively, the optical signals received from the optical sensor can be processed to derive signals indicative of the switching sequences, for example using a receiver module, and these signals provided to the processing module. The signals indicative of the switching sequences can be used in processing the light measurements by enabling each measurement of light to be associated with a particular lighting combination. This can enable the indications of light output by the processing module to be correctly associated with a light source, so that the information can be made more useful for feedback purposes.

Adequate measurement opportunities should be both present and taken advantage of to provide sufficient information to the processing module. For example, in order to determine an indication of light output by a selected light source, the switching sequences and the measurement sequences should be configured to provide adequate measurable combinations of light and adequate light measurements of these measurable combinations. For example, in one embodiment, if it is desired to measure the intensity of a blue light source, but the only measurable combinations of light present are red, green and red plus green, then no measurement of blue light is possible. This is equally true if adequate measurable combinations of light including blue light are present but not measured. Rather, at least one measurement of light which includes blue light and one which excludes blue light are required, although this may not guarantee adequacy.

As another example, suppose four different measurable combinations of light are measured, the four combinations corresponding to ambient light plus blue, ambient light plus red plus blue, ambient light plus blue plus green, and ambient light plus red plus blue plus green. In this case an indication of blue light still cannot be determined, since in every case blue light is measured alongside ambient light. In this case only indications of red, green and ambient plus blue light can be determined.

In certain embodiments of the present invention, the processing module is configured to determine an indication of whether the light measurements provided thereto are sufficient for providing desired indications of light output by selected light sources. If the light measurements are insufficient, the processing module can be configured to signal one or both of the controller module and the light measurement module to modify the switching sequences and measurement sequences, respectively, so as to improve sufficiency of the light measurements for processing.

In embodiments of the present invention, linear algebra tools can be employed for determining whether a proposed set of switching sequences and measurement sequences are adequate for determining desired indications of light output by one or more light sources. For example, in the case where the switching sequences result in a plurality of measurable combinations of light wherein each of a plurality of light sources is on or off in each combination, a matrix A can be defined having entries $a_{ij}$ for each row i and column j, where $a_{ij}=0$ if light source j is switched off in measurable lighting combination i, and $a_{ij}=1$ if light source j is switched on in measurable lighting combination i. In addition, ambient light can be considered as a light source in matrix A, for example light source number j=1. Depending on the proposed measurement sequence, a measurement matrix M can be derived from A by deleting rows that correspond to a measurable lighting combination that are not in fact measured according to the measurement sequence. Thus, a potential plurality of measurement matrices M can be derived from a single matrix A.

Given the above, the following results, applicable to embodiments of the present invention, can be shown. For a given set of switching sequences defining A, and for a given set of measurement sequences defining M, the property that M is invertible is equivalent to the property that a unique indication of each light source j can be determined using the light measurements resulting from M. It also follows that, if there exists a matrix, obtainable from A by possible deletion of rows of A, that matrix being invertible, then there exists a measurement sequence usable with the switching sequences defining A, the measurement sequence being usable to determine an indication of each light source j.

In one embodiment, the entries of $M^{-1}$ can be used in determining how to process the measurements, for example by suggesting linear mathematical operations that can be performed to determine indications of each light source from the provided light measurements. For example, for a fixed value of i and for a range of values of j, the $ij^{th}$ entry of $M^{-1}$ can be multiplied by the $j^{th}$ light measurement, and the results summed over j to obtain an indication of light output by the $i^{th}$ light source.

The above corresponds to an interpretation of processing light measurements to determine indications of light output by solving a linear system of equations. For example, suppose x is a vector having element $x_i$ representing an indication, such as luminous or radiant intensity, flux, spectral power, or the like, of the $i^{th}$ light source, and r is a vector having element $r_i$ representing the $i^{th}$ light measurement. Then, according to embodiments of the present invention, processing the light measurements is equivalent to determining x by solving a linear system of equations such as Ax=r or Mx=r. In some embodiments, this may be accomplished by calculating $x=M^{-1}r$.

In some embodiments, it may be desirable or necessary to essentially solve an overdetermined or underdetermined system of linear equations during processing. For example, there may be no vector x which exactly solves the system Ax=r, or there may be multiple such vectors x. This may be particularly useful if matrix A is not square, for example if more or fewer light measurements are used for processing than are required for determining a desired collection of indications of light. In this case there are several processing techniques for obtaining an approximate solution, or for selecting one solution from a plurality of possible solutions. One such technique, related for example to least-squares estimation, involves essentially calculating the Moore-Penrose pseudoinverse $A^+$ of matrix A, and setting $x=A^+r$. The pseudoinverse can be calculated for example by QR or singular value decomposition. The vector x representing indications of light output by the light sources thus obtained is a solution to Ax=r in the sense x minimizes $\|Ax-r\|$ where $\|\cdot\|$ represents the Euclidean norm, and x further has the smallest Euclidean norm if there are multiple such vectors x. That is, x obtained in this manner represents the "closest" possible solution to the system of equations Ax=r.

It is noted that other processing approaches are possible, for example algebraic conditions can be established for determining whether indications of light output by a subset of light sources can be determined even when it has been established that indications of light output by all light sources cannot be determined. For example, by deleting a column j of matrix A, the results above can be applied without considering the effects of light source corresponding to column j. By merging identical columns of matrix A, a system of equations can be derived whose solution provides indications of light output in some cases by combinations of light sources. It is also noted that processing may not necessarily carry out these algebraic operations explicitly, but instead may use equivalent analog or digital circuitry to obtain an analogous result.

In one embodiment, if there are n different light sources, including ambient light, for which light is to be discriminated, then it is required at least that light measurements corresponding to n different measurable combinations of light are taken. However, this may only provide a necessary but not sufficient condition for the light measurements to be adequate for determining an indication of light for all n light sources.

Method for Controlling and Measuring Light

Figure 3:
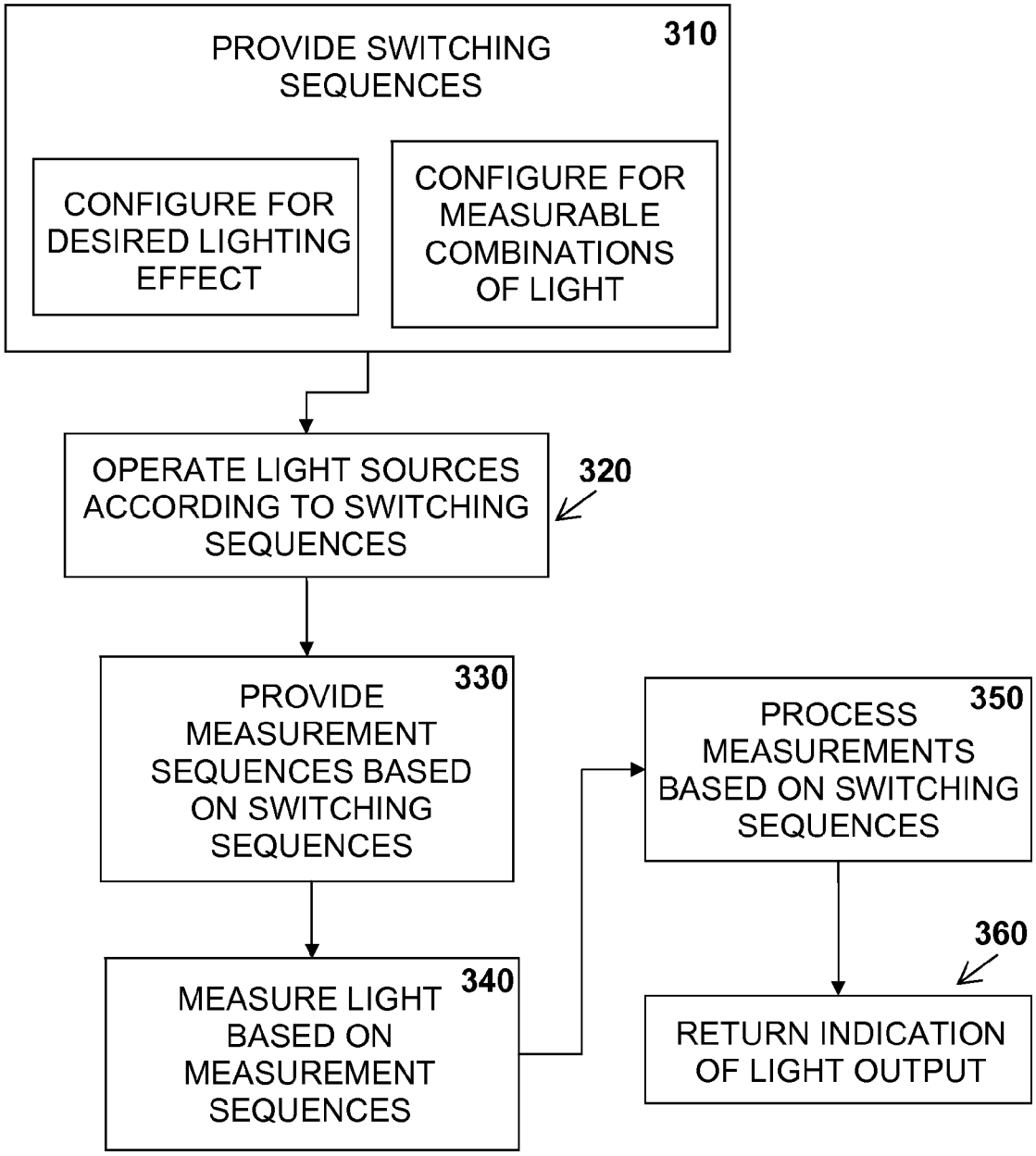
FIG. 3 illustrates a method for controlling and measuring light in accordance with an embodiment of the present invention.

FIG. 3 illustrates a method for controlling and measuring light in accordance with embodiments of the present invention. According to the method, two or more switching sequences are provided in step 310, each switching sequence for controlling operation of one or more light sources. The switching sequences are configured to result in generation of a desired lighting effect, such as color and intensity of light. The switching sequences are also configured to result in generation of two or more different measurable combinations of light. In step 320, the light sources are operated according to the switching sequences, for example by configuring switched drive currents supplied thereto in accordance with the switching sequences. In step 330, one or more measurement sequences are provided based on the switching sequences. In step 340, light is measured based on the measurement sequences, for example by using the measurement sequences to configure sampling times for measurements of light using an optical sensor. In step 350, the measurements are processed based on the switching sequences. For example, the switching sequences are used to associate measurements with configurations of light sources, so that processing operations can be performed to provide indications of light output by selected light sources. The indications are returned in step 360, for example to the controller for operation of a feedback loop.

EXAMPLES

Figure 4A:
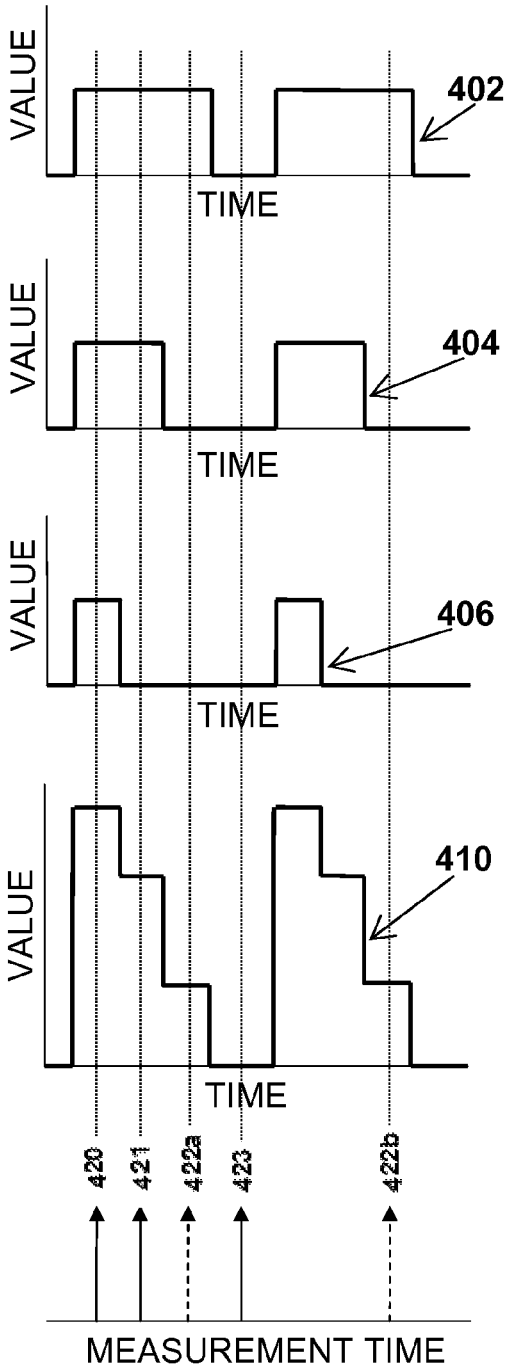
FIGS. 4A and 4B illustrate switching sequences and measurement sequences in accordance with embodiments of the present invention.
Figure 4B:
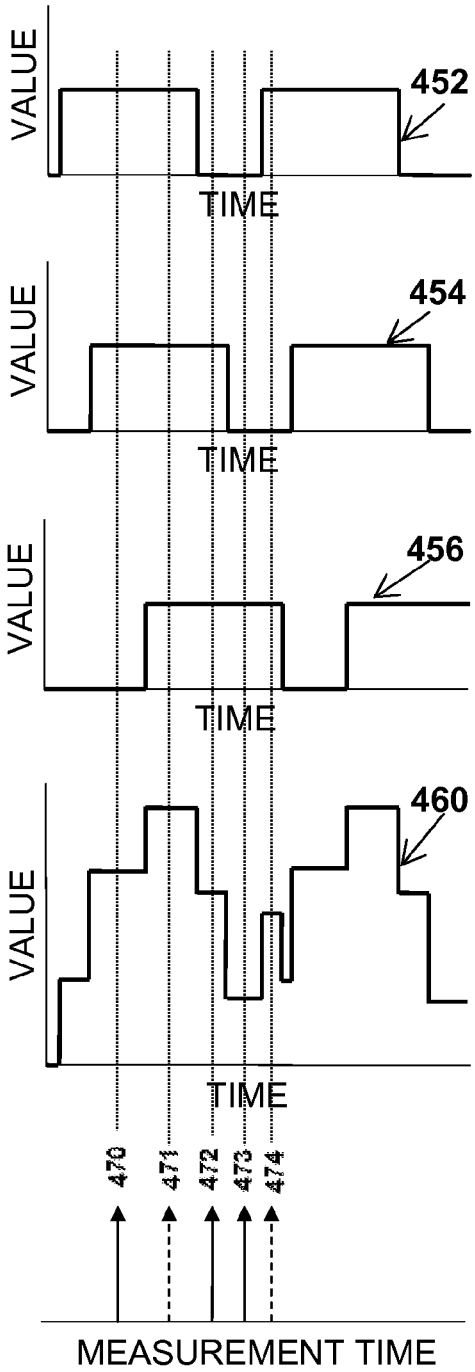

FIGS. 4A and 4B illustrate time-varying waveforms representative of light from three light sources, for example waveforms 402 and 452 may represent light from a red light source, waveforms 404 and 454 may represent light from a blue light source, and waveforms 406 and 456 may represent light from a green light source. The sum of waveforms 402, 404 and 406 is represented by waveform 410, and the sum of waveforms 452, 454 and 456 is represented by waveform 460. The switching sequences determine the switching times of the illustrated waveforms. For example, in FIG. 4A, the switching sequence for red light determines the times at which waveform 402 changes value. The switching sequences result in generation of different measurable combinations of light, for example represented by the different values taken by waveforms 410 and 460.

The waveforms 452, 454 and 456 illustrated in FIG. 4B may be derived, for example, by time-shifting PWM waveforms, initially configured in accordance with a desired lighting effect. In this case, the desired lighting effect would correspond to light resulting from about equal duty cycles of each of the red, blue and green light sources, the duty cycles being about 65%.

FIGS. 4A and 4B also illustrate potential measurements of light, determined by measurement sequences. For example, measurements of light can potentially be taken at a sequence of times, for example depicted by light measurement sequence 420, 421, 422*a* and 423 in FIG. 4A. Measurements can also be spread out across multiple switching cycles, for example measurement 422*b* can be used in place of measurement 422*a*. The measurement times are depicted as being substantially instantaneous for illustration purposes, but these can also encompass time intervals.

Referring to FIG. 4A, the matrix $M_1$ defined by the switching sequences and measurement sequences 420, 421, 422*a* and 423, or 420, 421, 422*b* and 423 can be expressed as:

$$M_1 = \begin{bmatrix} 1 & 1 & 1 & 1 \\ 1 & 1 & 1 & 0 \\ 1 & 1 & 0 & 0 \\ 1 & 0 & 0 & 0 \end{bmatrix}, M_1^{-1} = \begin{bmatrix} 0 & 0 & 0 & 1 \\ 0 & 0 & 1 & -1 \\ 0 & 1 & -1 & 0 \\ 1 & -1 & 0 & 0 \end{bmatrix}$$

Therefore, $M_1$ is invertible and hence the information is sufficient for determining indications of red, blue, green and ambient light. Moreover, reading off the rows of $M_1^{-1}$, the form of the inverse suggests that the indication of ambient light can be obtained directly from the fourth measurement, the indication of red light can be obtained by subtracting the fourth measurement from the third measurement, the indication of blue light can be obtained by subtracting the third measurement from the second measurement, and the indication of green light can be obtained by subtracting the second measurement from the first measurement.

Referring to FIG. 4B, the matrix $M_2$ defined by the switching sequences and measurement sequences illustrated by measurements 470, 471, 472 and 473 can be expressed, along with its inverse as:

$$M_2 = \begin{bmatrix} 1 & 1 & 1 & 0 \\ 1 & 1 & 1 & 1 \\ 1 & 0 & 1 & 1 \\ 1 & 0 & 0 & 1 \end{bmatrix}, M_2^{-1} = \begin{bmatrix} 1 & -1 & 0 & 1 \\ 0 & 1 & -1 & 0 \\ 0 & 0 & 1 & -1 \\ -1 & 1 & 0 & 0 \end{bmatrix}$$

Therefore, $M_2$ is invertible and hence the information is sufficient for determining indications of red, blue, green and ambient light. From the form of the inverse, for example, an indication of ambient light can be determined by subtracting the second measurement from the first measurement and adding the fourth measurement.

Referring to FIG. 4B, the matrix $M_3$ defined by the switching sequences and measurement sequences illustrated by measurements 470, 472, 473 and 474 can be expressed as:

$$M_3 = \begin{bmatrix} 1 & 1 & 1 & 0 \\ 1 & 0 & 1 & 1 \\ 1 & 0 & 0 & 1 \\ 1 & 1 & 0 & 1 \end{bmatrix}, M_3^{-1} = \begin{bmatrix} 1 & -1 & 2 & -1 \\ 0 & 0 & -1 & 1 \\ 0 & 1 & -1 & 0 \\ -1 & 1 & -1 & 1 \end{bmatrix}$$

Therefore, $M_3$ is invertible and hence the information is sufficient for determining indications of red, blue, green and ambient light. From the form of the inverse, for example, an indication of ambient light can be determined by subtracting the second measurement from the first measurement, adding twice the third measurement, and subtracting the fourth measurement.

Again referring to FIG. 4B, an alternative measurement sequence may be configured to obtain measurements 470, 471, 472, 473 and 474, which is more than adequate for determining indications of all light sources plus ambient light. Processing can then be equivalent to solving the overdetermined system of equations $M_4x=r$, where x represents indications of the light sources, r represents the measurements, and:

$$M_4 = \begin{bmatrix} 1 & 1 & 1 & 0 \\ 1 & 1 & 1 & 1 \\ 1 & 0 & 1 & 1 \\ 1 & 0 & 0 & 1 \\ 1 & 1 & 0 & 1 \end{bmatrix}, M_4^{+} = \begin{bmatrix} 1 & -1 & 0 & 1 & 0 \\ 0 & \frac{1}{2} & \frac{-1}{2} & \frac{-1}{2} & \frac{1}{2} \\ 0 & \frac{1}{2} & \frac{1}{2} & \frac{-1}{2} & \frac{-1}{2} \\ -1 & \frac{3}{4} & \frac{1}{4} & \frac{-1}{4} & \frac{1}{4} \end{bmatrix}$$

Here $M_4^+$ is the Moore-Penrose pseudoinverse. Thus, a possible solution is $x=M_4^+r$, this particular solution giving a vector x which minimizes $\|M_4x-r\|$ where $\|\cdot\|$ represents the Euclidean norm. That is, x obtained in this manner represents the "closest" possible solution to the system of equations. If there were multiple such vectors, vector x obtained in this manner would also have the smallest Euclidean norm.

Again referring to FIG. 4B, an alternative measurement sequence may be configured to obtain all of measurements 470, 471 and 472, which is less than adequate for determining indications of all light sources plus ambient light. Processing can then be equivalent to solving the underdetermined system of equations $M_5x=r$, where x represents indications of the light sources, r represents the measurements, and:

$$M_5 = \begin{bmatrix} 1 & 1 & 1 & 0 \\ 1 & 1 & 1 & 1 \\ 1 & 0 & 1 & 1 \end{bmatrix}, M_5^{+} = \begin{bmatrix} \frac{1}{2} & \frac{-1}{2} & \frac{1}{2} \\ 0 & 1 & -1 \\ \frac{1}{2} & \frac{-1}{2} & \frac{1}{2} \\ -1 & 1 & 0 \end{bmatrix}$$

Again, $M_5^+$ is the Moore-Penrose pseudoinverse. Thus, a possible solution is $x=M_5^+r$, this particular solution giving a vector x which minimizes $\|M_5x-r\|$ and x has the smallest Euclidean norm.

Figure 5:
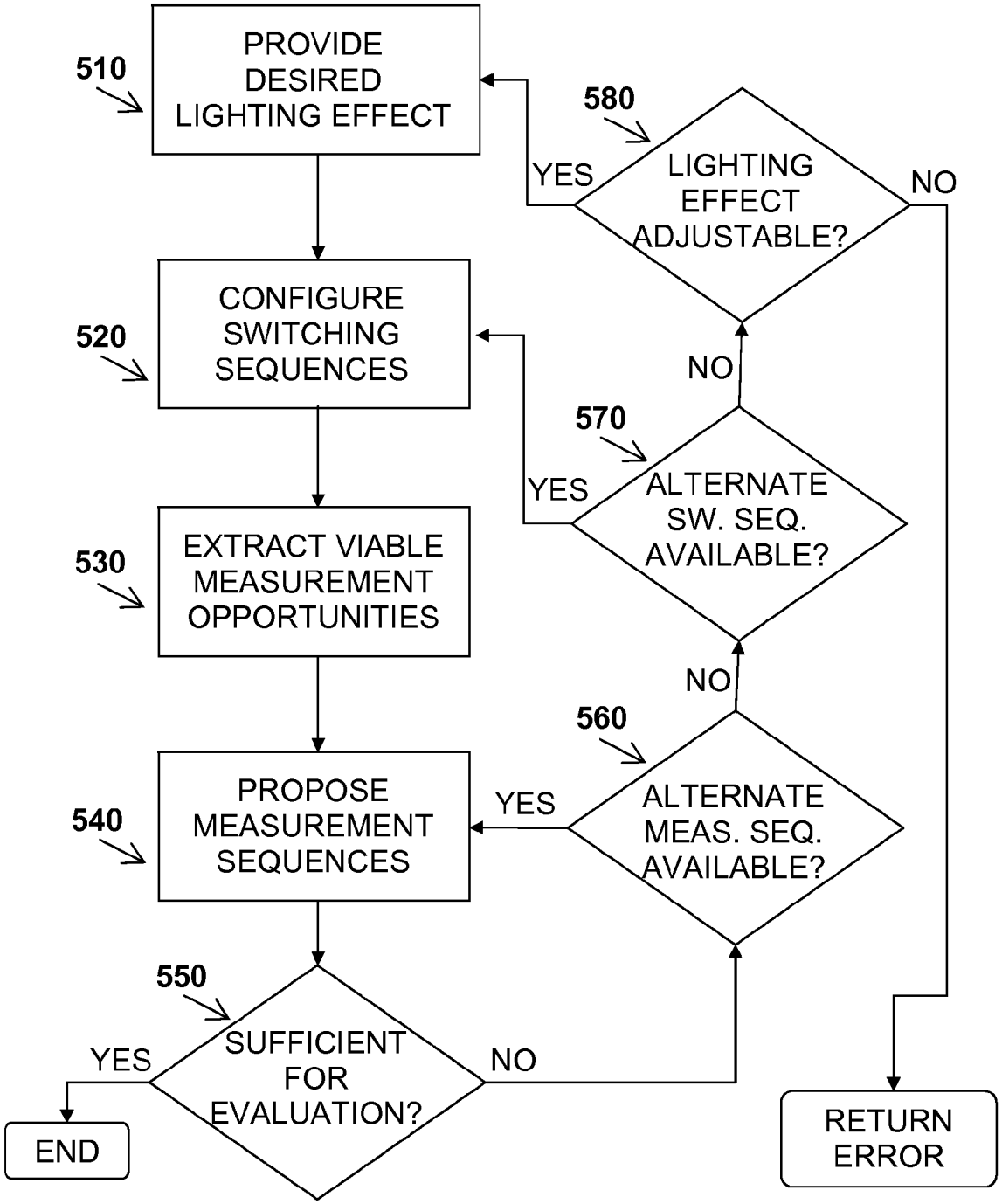
FIG. 5 illustrates a method for configuring switching sequences and measurement sequences in accordance with an embodiment of the present invention.

FIG. 5 illustrates a method for configuring switching sequences and measurement sequences in accordance with embodiments of the present invention. In this method, a desired lighting effect is provided in step 510. This may be used to constrain potential switching sequences, for example by considering only switching sequences that will result in the desired lighting effect. In step 520, a switching sequence is configured, possibly subject to the above constraints. In step 530, the switching sequence is analyzed to determine the measurement opportunities or measurable combinations of light that are exhibited in accordance with the configured switching sequence. In step 540, a measurement sequence is proposed which results in measurement of at least a portion of these measurable combinations of light.

Continuing with reference to FIG. 5, once switching sequences and measurement sequences have been proposed, a determination 550 can be made as to whether these are sufficient for evaluating or determining one or more desired indications of light output by one or more selected light sources. For example, this may include determining whether sufficient measurements are available which can be processed to determine the desired indications. If the sequences are sufficient, the switching and measurement sequences are accepted and the process ends. Otherwise, a determination 560 can be made as to whether another measurement sequence should be considered. If so, then the new measurement sequence is proposed in step 540 and the process continues. Otherwise, a determination 570 can be made as to whether another switching sequence should be considered. If so, then the new switching sequence is proposed in step 530 and the process continues. Otherwise, an optional determination 580 can be made as to whether the desired lighting effect should be adjusted. If so, then the new desired lighting effect is provided in step 510 and the process continues. Otherwise, an error is returned indicating that sufficient switching and measurement sequences cannot be found.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

What is claimed is:

1. An apparatus, comprising:

a controller module operatively coupled to two or more light sources, at least a first one of the light sources being configured to emit light having a first color and a second one of the light sources being configured to emit light having a second color, wherein the first and second colors are different than each other, the controller module configured to generate two or more switching sequences, each switching sequence for controlling operation of one of the light sources, the two or more switching sequences configured to result in generation of a desired lighting effect and two or more different measurable combinations of light, at least one measurable combination comprising light from one or more of the light sources;

a broadband optical sensor configured to receive each different measurable combination of light, to detect each different measurable combination of light, and in response to each different measurable combination of light to output an optical sensor output signal indicating a total intensity of the measurable combination of light;

a light measurement module operatively coupled to the controller module and configured to receive signals indicative of the switching sequences, the light measurement module configured to define one or more measurement sequences based on the switching sequences, the light measurement module further being operatively connected to the broadband optical sensor to receive the optical sensor output signal and further being configured to produce one or more light measurements in response to the optical sensor output signal and the based on the measurement sequences; and a processing module operatively coupled to the light measurement module and the controller module, the processing module configured to determine an indication of the light output by at least one of the two or more light sources based at least in part on the one or more light measurements and the two or more switching sequences.

2. The apparatus according to claim 1, wherein the controller module is further configured to provide each of the two or more different measurable combinations of light for at least a predetermined minimum amount of time.

3. The apparatus according to claim 1, wherein the controller module is further configured to adjust the two or more switching sequences, based on the indication of light output by at least one of the two or more light sources, to facilitate generation of the desired lighting effect.

4. The apparatus according to claim 1, wherein the processing module is further configured to determine an indication of ambient light.

5. The apparatus according to claim 1, wherein the processing module is configured to determine the indication of light output by solving a linear system of equations.

6. The apparatus according to claim 1, wherein the processing module is further configured to determine whether the provided one or more light measurements are sufficient for determining one or more desired indications of light output.

7. The apparatus according to claim 6, wherein the processing module is further configured to provide an indication to the controller module and/or the measurement module regarding whether the provided one or more light measurements are sufficient for determining one or more desired indications of light output.

8. A method for controlling and measuring light comprising light generated by two or more light sources, the method comprising:

providing two or more switching sequences, each switching sequence for controlling operation of one of the light sources, at least a first one of the light sources being configured to emit light having a first color and a second one of the light sources being configured to emit light having a second color, wherein the first and second colors are different than each other, the two or more switching sequences configured to result in generation of a desired lighting effect and two or more different measurable combinations of light, at least one measurable combination comprising light from one or more of the light sources;

defining one or more measurement sequences based on the switching sequences;

detecting the measurable combinations of light with a broadband optical sensor which in response to each different measurable combination of light outputs an optical sensor output signal indicating a total intensity of the measurable combination of light;

producing one or more light measurements in response to the optical sensor output signal, based on the measurement sequences; and processing the one or more light measurements to determine an indication of the light output by at least one of the two or more light sources based at least in part on the one or more light measurements and the two or more switching sequences.

9. The method according to claim 8, wherein each of the two or more different measurable combinations of light are provided for at least a predetermined minimum amount of time.

10. The method according to claim 9, further comprising:

determining whether each of the two or more different measurable combinations of light are provided for at least the predetermined minimum amount of time; and adjusting the two or more switching sequences if at least one of the two or more different measurable combinations of light is determined to be provided for less than the predetermined minimum amount of time.

11. The method according to claim 8, further comprising adjusting the two or more switching sequences, based on the indication of light output by at least one of the two or more light sources, to facilitate generation of the desired lighting effect.

12. The method according to claim 8, wherein processing of the one or more light measurements includes determining an indication of ambient light.

13. The method according to claim 8, wherein determining an indication of light output comprises solving a linear system of equations.

14. The method according to claim 8, further comprising:

determining whether the provided one or more light measurements are sufficient for determining one or more desired indications of light output; and adjusting the two or more switching sequences if the provided one or more light measurements are determined to be insufficient for determining one or more desired indications of light output.

15. A computer program product comprising a non-transitory computer readable medium having recorded thereon statements and instructions for execution by a processor to carry out a method for controlling and measuring light comprising light generated by two or more light sources, the method comprising the steps of:

producing two or more switching sequences, each switching sequence for controlling operation of one of the light sources, at least a first one of the light sources being configured to emit light having a first color and a second one of the light sources being configured to emit light having a second color, wherein the first and second colors are different than each other, the two or more switching sequences configured to result in generation of a desired lighting effect and two or more different measurable combinations of light, at least one measurable combination comprising light from one or more of the light sources;

defining one or more measurement sequences based on the switching sequences;

detecting the measurable combinations of light with a broadband optical sensor which in response to each different measurable combination of light outputs an optical sensor output signal indicating a total intensity of the measurable combination of light;

producing one or more light measurements in response to the optical sensor output signal, based on the measurement sequences; and processing the one or more light measurements to determine an indication of the light output by at least one of the two or more light sources based at least in part on the one or more light measurements and the two or more switching sequences.

16. The apparatus of claim 1, wherein the light measurement module is connected to receive the signals indicative of the switching sequences from the controller module, and is configured to produce the one or more measurement sequences in response to the signals indicative of the switching sequences.

17. The apparatus of claim 1, wherein the at least a third one of the light sources is configured to emit light having a third color is different than the first color and the second color, and wherein the two or more switching sequences include a first switching sequence for switching the first one of the light sources, a second switching sequence for switching the second one of the light sources, and a third switching sequence for switching the third one of the light sources, wherein the first, second, and third switching sequences are all different from each other.

18. The apparatus of claim 17, wherein the at least two different measurable combinations of light each include a measurable combination of at least two of the first, second, and third colored lights.

19. The apparatus of claim 4, wherein the processing module is further configured to determine an indication of ambient light which is not emitted by any of the light sources only from the measurements of the two or more different measurable combinations of light by the light measurement module, wherein each of the two or more different measurable combinations of light includes light emitted by at least one of the two or more light sources.

20. The method of claim 8, wherein the at least a third one of the light sources is configured to emit light having a third color is different than the first color and the second color, and wherein the two or more switching sequences include a first switching sequence for switching the first one of the light sources, a second switching sequence for switching the second one of the light sources, and a third switching sequence for switching the third one of the light sources, wherein the first, second, and third switching sequences are all different from each other, and wherein the at least two different measurable combinations of light each include a measurable combination of at least two of the first, second, and third colored lights.

* * * * *